US005123710A

United States Patent [19]

Morrell et al.

[11] Patent Number: 5,123,710

[45] Date of Patent: Jun. 23, 1992

[54] IMPACT ASSISTED SEGMENTED CUTTERHEAD

[75] Inventors: Roger J. Morrell, Bloomington; David A. Larson, Minneapolis; Peter L. Ruzzi, Eagan, all of Minn.

[73] Assignee: The United States of America as represented by the Secretary of the Interior, Washington, D.C.

[21] Appl. No.: 685,115

[22] Filed: Apr. 15, 1991

[51] Int. Cl.[5] ..... E22C 3/02

[52] U.S. Cl. ..... 299/69; 37/DIG. 18; 173/162.1

[58] Field of Search ..... 299/37, 67, 69, 70, 299/94; 37/141 R, DIG. 18; 173/139, 162.1

[56] References Cited

U.S. PATENT DOCUMENTS 2,228,445 1/1941 DeVelbiss ..... 299/67
2,443,492 6/1948 Austin ..... 37/DIG. 18 X
3,305,953 2/1967 Von Mehren et al. ... 37/DIG. 18 X
4,625,438 12/1986 Mozer ..... 37/DIG. 18 X
4,724,912 2/1988 Miyazaki et al. ..... 173/162.1

FOREIGN PATENT DOCUMENTS 1116156 9/1984 U.S.S.R. ..... 299/69
1149353 4/1969 United Kingdom ..... 299/67

*Primary Examiner*—David J. Bagnell
*Attorney, Agent, or Firm*—E. Philip Koltos

[57] ABSTRACT

An impact assisted segmented cutterhead device is provided for cutting various surfaces from coal to granite. The device comprises a plurality of cutting bit segments deployed in side by side relationship to form a continuous cutting face and a plurality of impactors individually associated with respective cutting bit segments. An impactor rod of each impactor connects that impactor to the corresponding cutting bit segment. A plurality of shock mounts dampening the vibration from the associated impactor. Mounting brackets are used in mounting the cutterhead to a base machine.

20 Claims, 2 Drawing Sheets

IMPACT ASSISTED SEGMENTED CUTTERHEAD

FIELD OF THE INVENTION

This invention relates generally to devices and tools for mining and more specifically, to a segmented cutterhead for these purposes.

BACKGROUND OF THE INVENTION

Minerals or debris to be extracted are generally removed from the exposed face of a deposit. The face may, for example, be the wall or the end of a tunnel, stope room, or bore. When percussive techniques are used, a tool bit is struck by a hammer mechanism, and is thereby driven against and into the face to fracture and dislodge material from the face. These techniques are widely used, and there are many tool bits for this purpose.

Existing tool bits suffer from a number of inherent disadvantages, and the bits themselves raise problems for the system in which they are used. For example, the working room available in many important mines are very limited. Tools used in such environments are often mounted so that they move along an arc, while their support vehicle crawls along a direct path. In the course of this scoop-like movement, the tool bit is driven against the face to fracture it. A percussive hammer delivers successive blows to the base of the bit. These hammers have substantial axial and lateral dimensions, and the tool bit itself adds significantly to the axial length of the assembled tool and bit.

Material on the face is most advantageously removed by a chipping action in which a blow is delivered at an acute angle to the face. There are considerable potential advantages in making this angle as large as possible, but existing tools render this difficult.

A commercially available system has been designed to overcome some of the above mentioned problems. The Voest-Alpine (VAPCUT) system applies a vibratory force to the digging teeth on buckets of shovels, backhoes, and other mining machines. The teeth associated with the buckets are widely spaced with little or no cutting taking place between them. This large space between the teeth makes the device ineffective when used in hard material such as rock. The VAPCUT system uses a special low-mass hammer that is specially designed for the system. As a consequence, other commercial impactors cannot be used because of their bulk and size.

U.S. Pat. No. 4,783,123 (Ottestad) discloses an impact ripper which uses a single impactor in combination with a single bit. This single impactor construction has the disadvantage that the cutter head size is limited by the impact energy available from the single impactor. Further, the cutter is made of steel and cannot be used in cutting hard rock.

SUMMARY OF THE INVENTION

According to the invention, an impact assisted, segmented cutterhead device is provided which overcomes the above-mentioned problem. The cutterhead device comprises a plurality of cutting bit segments deployed in side-by-side relationship to form a continuous cutting face,a plurality of impactors each individually associated with a corresponding one of the plurality of cutting bit segments, an impactor rod for each impactor for connecting that impactor to the corresponding bit segment, a plurality of shock mounts for dampening the vibration from the respective impactor, and mounting means, such as mounting brackets, for mounting the cutterhead to a base machine.

The segmented cutterhead of the invention is capable of cutting a wide variety of materials ranging from unconsolidated material and soft coal to very hard rock such as granite and basalt. The device can be used for both surface and underground mining as well as for construction work where digging or demolition is required. The cutterhead can be constructed in a wide variety of sizes with different power capabilities, and can employ many different types of bits so as to suit many different cutting conditions. In many underground mines, the cutterhead can be used as the primary excavation source and can thus replace the drill-blast method of excavation.

The use of multiple bit segments allows the cutterhead of the invention to be constructed in any size and shape whereas the individual segments themselves can be of reasonable size for ease of fabrication, replacement, and repair. The large continuous cutting edge formed by the bit segments enables larger cuttings, is more energy efficient and, therefore, requires less horsepower to operate. The provision of multiple bits allows the load on each bit to be independently optimized for greater effectiveness and enables selective replacement on only those damaged or worn bits and not the entire cutterhead. Further, more impact power can be incorporated into the head. The segmented construction enables maximum utilization of power where required. In addition, bits of different sizes or shapes can be provided on the same cutterhead which enable the cutterhead to be custom tailored to the job. The cutterhead of the invention can be used with commercially available impactors which significantly reduces cost and increases versatility, and is able to be mounted or retrofitted on a wide variety of base machines such as shovels, backhoes, roadloaders, continuous miners, ripperminers and the like, so that a variety of materials from soft coal to hard rock can be excavated thereby.

Other features and advantages of the invention will be set forth in, or apparent from, the following detailed description of the preferred embodiment of the invention.

DESCRIPTION OF THE PREFERRED EMBODIMENTS

Figure 1:
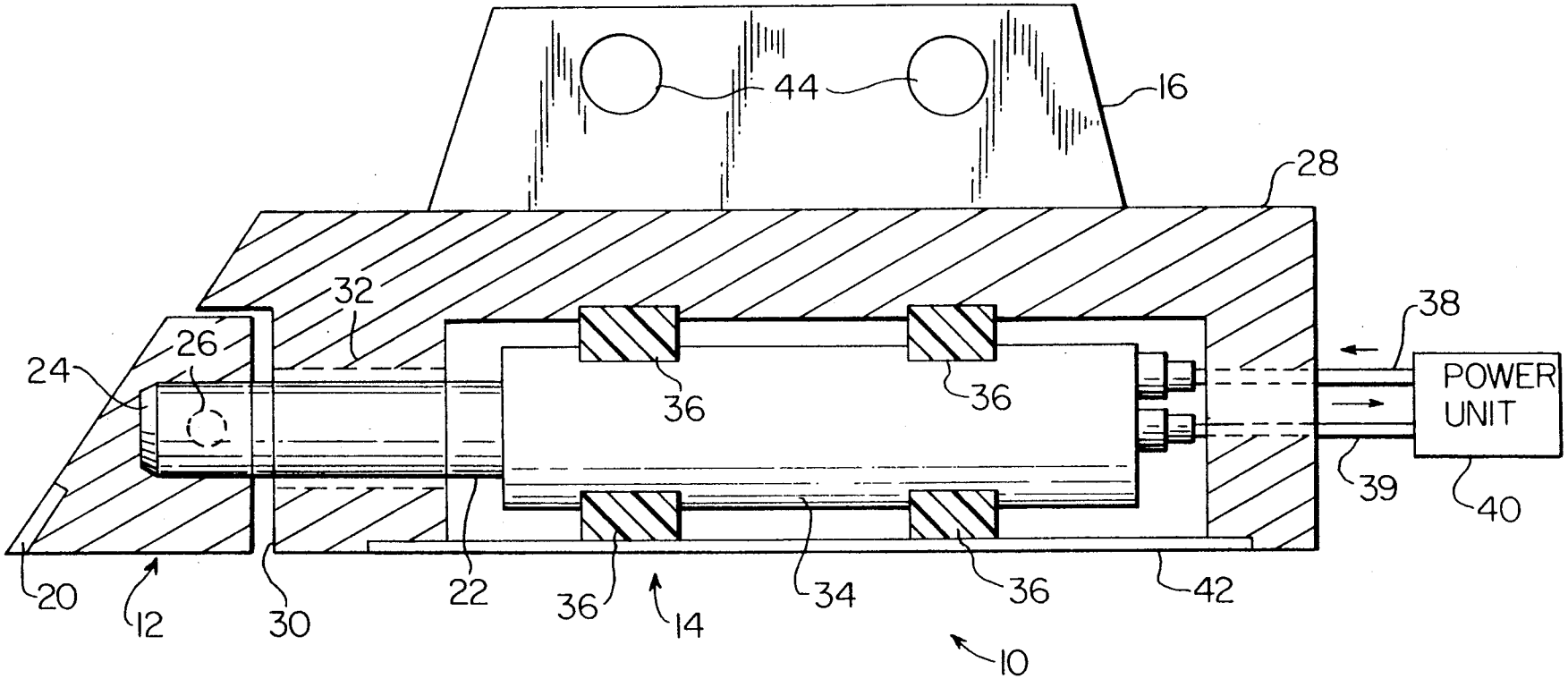
FIG. 1 is a longitudinal cross sectional view of a segmented cutterhead constructed in accordance with a preferred embodiment of the invention.
Figure 2:
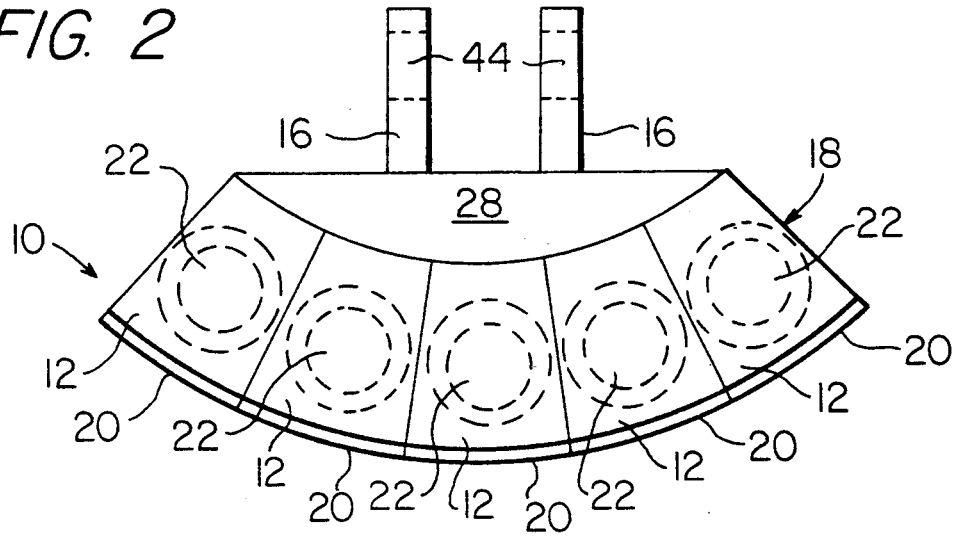
FIG. 2 is a front elevational view of the cutterhead of FIG. 1.
Figure 3:
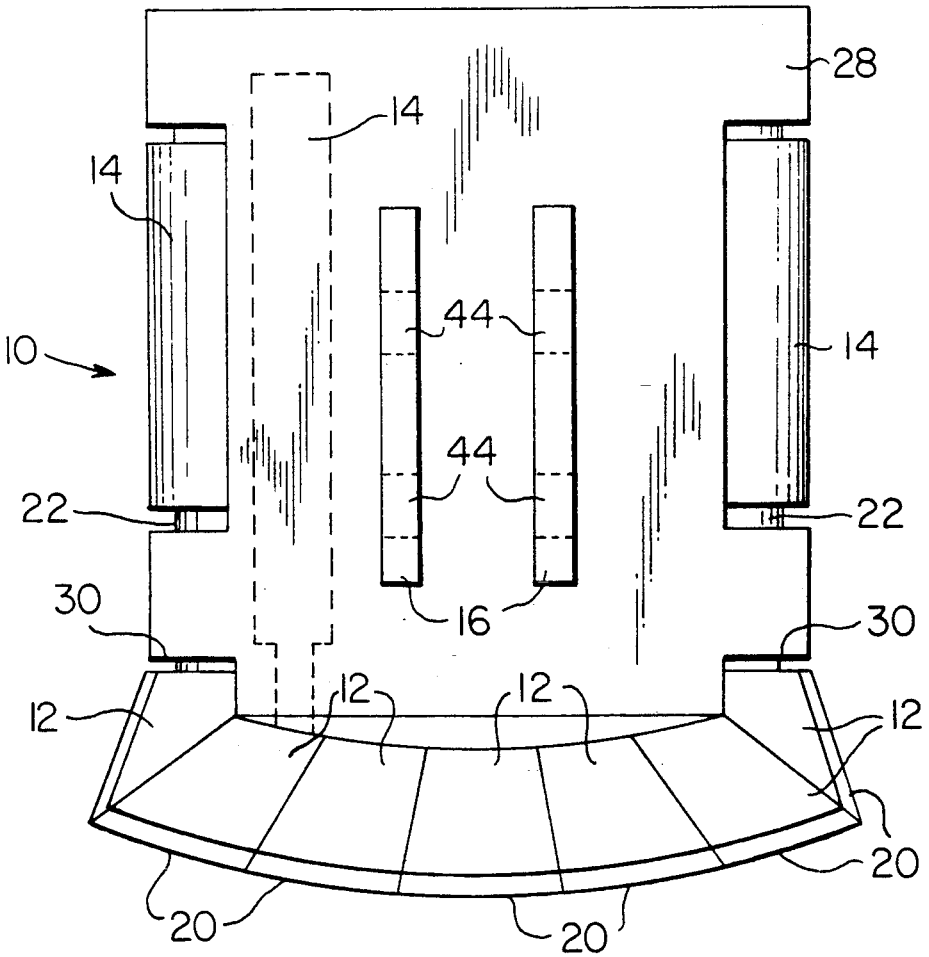
FIG. 3 is top plan view of the cutterhead of FIG. 1.

Referring to FIGS. 1, 2, and 3, a segmented cutterhead is shown which is generally denoted 10 and which is constructed in accordance with a preferred embodiment of the invention. The segmented cutterhead 10 comprises a plurality of bit segments 12, a like plurality of impactor units 14, and mounting brackets 16 for connecting the cutterhead to a base machine.

The bit segments 12 can be any size, but in a typical applications are 4 to 12 inches in width, depending on the size of the impactor segment 14. Bit segments 12 can be constructed of tool steel and heat treated for use in softer materials or can be equipped with a cutting edge, denoted 20, of tungsten carbide or other hard material for cutting harder materials such as granite. The bit segments 12 each have a circular arc-shaped cutting edge and together form a continuous face 18. The overall shape of the continuous face 18 can be circular, flat, or some combination of both and can vary in width in typical applications from one to four feet. The bit segments 12 are designed to be resharpened multiple times using standard grinding methods and can be resharpened on the cutterhead 10 if a portable grinder is used. The bit segments 12 can be made with different rake and clearance angles to suit the cutting conditions to be encountered.

Each bit segment 12 is attached an associated impactor segment 14 by an impactor rod 22. Each impactor rod 22 has a tapered portion 24 at the distal end which is received in a corresponding recess in the associated bit segment 12. A suitable connection arrangement, which may comprise a connector pin 26 as shown, mating threads on the rod 22 and the corresponding bit segment 12, or any other suitable connector known in the art, is used in attaching the distal end of impactor rod 22 to the corresponding bit segment 12.

The impactor segments 14 are housed in a main body 28. The main body 28 includes optional mounting brackets 16 attached to the top surface of the body 28 by conventional means such as welding. Mounting brackets 16 include holes 44 therein which enable the segmented cutterhead 10 to be mounted to a conventional boom. Alternatively, without mounting brackets 16 attached to the main body 28, the segmented cutterhead 10 may be mounted to a conventional bucket. It will be appreciated that these are simply two examples of the applications to which cutterhead 10 can be put and that cutterhead 10 can be used on many other types of machines. In the illustrative embodiment, body 28 has a specially designed back stop region 30 located behind the bit segments 12. Each impactor rod 22 extends through the body 28 and is attached to a corresponding impactor segment 14. Impactor rod 22 is supported in body 28 by a conventional bushing 32 which surrounds rod 22 and isolates the rod 22 from body 28.

As shown in FIG. 1, each impactor segment 14 comprises a conventional impactor 34, a plurality of shock mounts 36, a power input line 38, a power output line 39, and a drive or power unit 40. Impactor rod 22 is attached to impactor 34 in a conventional manner so that impactor 34 transmits impact forces generated thereby to the corresponding bit segment 12. A removable cover plate 42 is attached to the bottom of body 28 for providing access to the impactor segments 14 located thereabove.

The impactors 34 can be a variety of types and sizes including those commonly referred to as hammers or breakers. Impactors 34 can be powered from a variety of sources including hydraulic, pneumatic, diesel, and electrical, and these impactors typically weigh from a few hundred pounds to several thousand pounds. The blow or impact rates for the impactors 34 range from several hundred to several thousand blows per minute and the blow energies can vary from 100 ft-lb to 20,000 ft-lb and more. Thus, it will be appreciated that the blow energy and blow frequency are design variables which can be selected to yield the optimum combination for a given application.

Considering the overall operation of the segmented cutter head 10, the continuous face 18 formed by bit segments 12 is moved across the material to be cut in a generally circular digging motion by a base machine. The thrust force required to hold the segmented cutterhead 10 against the rock, and the cutting force required to move the cutterhead 10 across the rock vary depending upon the depth of cut and the material being cut. In soft materials, such as coal, the cutting force may only be a few thousand pounds, while in hard materials, such as granite, the force may be several hundred thousand pounds. The cutterhead must be held in the proper orientation to the material being cut. Normally, the cutterhead is positioned to provide an attack angle, i.e., the angle between the face of the material being cut and the bottom surface of the cutting bit segments 12, of between 5° and 30°. Generally, the larger the attack angle, the better the penetration ability of the cutterhead 10. The cutterhead can be operated with or without impact assistance, but the impact (if required or desired) is automatic and requires no assistance from the operator. The steady push force is supplied by the mounting brackets 16 which also resists all thrust and side forces. The impact force for each bit segment 12 is supplied by a separate impactor 34. In other words, generally one impactor 34 is provided for each bit segment 12.

Continuing a consideration of the operation of cutterhead 10, as the bit segments 12 penetrate into the material, the bit segments 12 are also pushed back against their associated backstop regions 30. The total travel is small, but sufficient to activate the corresponding impactors 34. The cutterhead is designed so that each bit segment 12 is given a steady push force by the associated backstop region 30 and simultaneously is given a series of high energy impacts by the corresponding impactor 34. As mentioned above, the impactor 34 is commercially available device and is activated automatically when a load is placed against the impactor rod 22. Only those bit segments 12 in contact with the rock will be fully forced back against the backstop region 30 and will be activated by the associated impactor 34. In absence of cutting, the impactors 34 will stop automatically. In a preferred embodiment, during a cutting cycle, each bit segment 12 will activate and deactivate the associated impactor 34 multiple times and independently of all other segments. The automatic shut off which occurs when a bit segment 12 is unloaded prevents damage to the bit segment 12 and the impactor rod 22.

Although the present invention has been described to specific exemplary embodiments thereof, it will be understood by those skilled in the art that variations and modifications can be effected in these exemplary embodiments without departing from the scope and spirit of the invention.

What is claimed is:

1. An impact assisted segmented cutterhead device comprising: a plurality of cutting bit segments disposed in side-by-side relationship to form a continuous cutting face; and impactor means for imparting high energy impacts to said plurality of cutting bit segments, the bit segments of said continuous face forming a cutting edge having a semi-circular shape.

2. The device recited in claim 1 wherein said impactor means comprises a plurality of impactors individually associated with respective one of said plurality of cutting bit segments.

3. The device recited in claim 2 wherein each of said impactors includes an impactor rod for connecting that impactor to a corresponding cutter bit segment.

4. The device recited in claim 3 further comprising a means for reducing shock produced by said plurality of impactors.

5. The device recited in claim 4 wherein said means for reducing shock comprises a plurality of shock mounts for dampening vibration produced by said impactors.

6. The device recited in claim 1 further comprising mounting means for attaching said cutterhead device to a base machine.

7. The device recited in claim 6 wherein said mounting means comprises at least one mounting bracket.

8. An impact assisted segmented cutterhead device comprising: a plurality of cutting bit segments disposed in side-by-side relationship to form a continuous cutting face; and impactor means for imparting high energy impacts to said plurality of cutting bit segments, said plurality of cutting bit segments comprising bits of different widths.

9. The device recited in claim 8 wherein said impactor means comprises impactors of different sizes.

10. The device recited in claim 8 wherein said impactor means comprises impactors providing different impact rates.

11. An impact assisted segmented cutterhead device comprising: a plurality of cutting bit segments disposed in side-by-side relationship to form a continuous cutting face; and impactor means for imparting high energy impacts to said plurality of cutting bit segments, said plurality of cutting bit segments comprising bits of different shapes.

12. The device recited in claim 11 wherein said impactor means comprises a plurality of impactors of different sizes.

13. The device recited in claim 11 wherein said impactor means comprises a plurality of impactors providing different impact rates.

14. An impact assisted segmented cutterhead device comprising: a plurality of cutting bit segments disposed in side-by-side relationship to form a continuous cutting face; and impactor means for imparting high energy impacts to said plurality of cutting bit segments, said impactor means comprising a plurality of impactors individually associated with respective ones of said plurality of cutting bit segments, and said plurality of impactors comprising impactors of different sizes.

15. The device recited in claim 14 wherein said plurality of bit segments comprises bits of different widths.

16. The device recited in claim 14 wherein said plurality of bit segments comprises bits of different shapes.

17. An impact assisted segmented cutterhead device comprising: a plurality of cutting bit segments disposed in side-by-side relationship to form a continuous cutting face; and impactor means for imparting high energy impacts to said plurality of cutting bit segments, said impactor means comprising a plurality of impactors individually associated with respective ones of said plurality of cutting bit segments, and said plurality of impactors comprising impactors providing different impact rates.

18. The device recited in claim 17 further comprising at least one mounting bracket attached to said segmented cutterhead; and at least one hole in said mounting bracket for attaching said mounting bracket to a base machine.

19. The device recited in claim 17 wherein said plurality of bit segments comprises bits of different widths.

20. The device recited in claim 17 wherein said plurality of bit segments comprises bits of different shapes.

* * * * *